US011429066B2

(12) United States Patent
Rey-Mermet et al.

(10) Patent No.: US 11,429,066 B2
(45) Date of Patent: Aug. 30, 2022

(54) INSTANTANEOUS CONTROL DEVICE FOR A DATE DISPLAY OF A TIMEPIECE

(71) Applicant: Société anonyme de la Manufacture d'horlogerie Audemars Piguet & Cie, Le Brassus (CH)

(72) Inventors: Gilles Rey-Mermet, Le Sentier (CH); Nicolas Goy, Le Sentier (CH)

(73) Assignee: Sociéte anonyme de la manufacture d'horlogerie Audemars Piquet & Cie, Le Brassus (CH)

( * ) Notice: Subject to any disclaimer, the term of this patent is extended or adjusted under 35 U.S.C. 154(b) by 743 days.

(21) Appl. No.: 16/408,269

(22) Filed: May 9, 2019

(65) Prior Publication Data

US 2019/0384223 A1 Dec. 19, 2019

(30) Foreign Application Priority Data

Jun. 19, 2018 (EP) ..... 18178458

(51) Int. Cl.
*G04B 19/253* (2006.01)

(52) U.S. Cl.
CPC . *G04B 19/25386* (2013.01); *G04B 19/25353* (2013.01)

(58) Field of Classification Search
CPC ..... G04B 19/247–25393
See application file for complete search history.

(56) References Cited

U.S. PATENT DOCUMENTS 3,177,647 A * 4/1965 Meyer ..... G04B 19/25353 74/827
3,451,211 A 6/1969 Nakagawa
3,645,090 A * 2/1972 Mochizuki ..... G04B 11/006 368/32

(Continued)

FOREIGN PATENT DOCUMENTS

CH 708 338 A2 1/2015
CH 706799 B1 * 6/2018 ..... G04B 19/2536

(Continued)

OTHER PUBLICATIONS

Mori, Yuichi, English Translation of CH 706799, originally published on Feb. 14, 2014, retrieved from Espacenet on Mar. 26, 2022, full document (Year: 2014).*

*Primary Examiner* — Daniel P Wicklund
(74) *Attorney, Agent, or Firm* — Christensen, Fonder, Dardi & Herbert PLLC

(57) ABSTRACT

An instantaneous date control device for a timepiece, in particular for a mechanical wristwatch, including: a date disc, a gear train forming a kinematic linkage between the control device and a horological movement of said timepiece, a first mobile including a first toothed wheel driven at a speed of one turn per day and a cam mounted freely rotatably, over a limited angular range and/or in a single direction of rotation, as well as temporarily coupled in rotation to said first toothed wheel, a second mobile including a second toothed wheel driven at a speed of one turn per day, an unlocking and driving yoke carrying a feeler bearing on said cam and a driving finger which can mesh with teeth located on the date disc, an unlocking and driving spring, and a retaining means allowing to secure the angular position of the date disc between two instantaneous jumps.

17 Claims, 6 Drawing Sheets

(56) References Cited

U.S. PATENT DOCUMENTS

| | | | | |
|---|---|---|---|---|
| 3,695,029 | A * | 10/1972 | Tripet | G04B 19/25 368/37 |
| 3,882,669 | A * | 5/1975 | Jakob | G04B 19/25386 368/38 |
| 2008/0181060 | A1* | 7/2008 | Mahler | G04B 19/02 368/220 |
| 2011/0158052 | A1* | 6/2011 | Suzuki | G04B 19/247 368/38 |
| 2012/0057434 | A1* | 3/2012 | Rudaz | G04B 19/2538 368/220 |
| 2016/0202664 | A1* | 7/2016 | Carreno | G04B 19/25306 368/37 |
| 2017/0153602 | A1* | 6/2017 | Rudaz | G04B 19/253 |

FOREIGN PATENT DOCUMENTS

| | | | |
|---|---|---|---|
| DE | 1 673 663 | A1 | 7/1971 |
| DE | 10 2015 011 324 | B3 | 9/2016 |

* cited by examiner

INSTANTANEOUS CONTROL DEVICE FOR A DATE DISPLAY OF A TIMEPIECE

RELATED APPLICATION

The present application claims priority to European Patent Application No. 18178458.8, filed Jun. 19, 2018, the disclosure of which is hereby incorporated by reference herein in its entirety.

FIELD OF THE INVENTION

The present invention relates to a device for the instantaneous control of the date for a date display of a timepiece, in particular for a date display of a mechanical wristwatch, and to a horological movement, respectively to a timepiece comprising said instantaneous date control device.

BACKGROUND

In general, date displays of the instantaneous change type are known in horology. These displays overcome the disadvantages of date displays of the calendar-dragging change type which are normally rather simple in construction, but can only execute a date change which can be fairly slow and is thus clearly perceptible to the user. Amongst others, this is noticeable by the fact that the displayed date is no longer centered in the date window for several minutes or even hours while the date disc is being displaced. In order to overcome these disadvantages, instantaneous change type date displays are equipped with a more complicated mechanism which allows changing the date by means of an instantaneous rotation of the date disc, i.e. by an instantaneous jump which normally occurs every day at midnight.

This type of instantaneous date display is also known from the document DE 1 673 663 which discloses an instantaneous date mechanism comprising a first mobile carrying a cam which is free to rotate over a limited angular range, a control lever applied to said cam via a first spring, and an actuating lever which is driven by said control lever and which can cause a date disc to turn step by step via a driving finger. Said actuating lever is equipped with a sliding guide in which a pin that is fixedly mounted to a bridge of the respective timepiece is housed and the driving finger, articulated on the actuating lever, is biased by a second spring in the direction of the date disc. The German patent DE 10 2015 011 324 describes a mechanism similar to that disclosed in the document DE 1 673 663 and also comprising a first mobile carrying a cam, but additionally having a second mobile onto which is fixed a pin which, instead of being fixed to a bridge as in the mechanism of the document DE 1 673 663, is housed in an eccentric manner in a sliding guide of a driving lever. Furthermore, the mechanism of the document DE 10 2015 011 324 combines the control lever and the actuating lever of the mechanism in accordance with the document DE 1 673 663 into a part called the date unlocking rocker. And the sliding guide provided on the actuation lever in the mechanism in accordance with the document DE 1 673 663 is arranged on said driving lever in the mechanism in accordance with the document DE 10 2015 011 324. Said driving lever is in this case, simultaneously with suppressing the second spring biasing the driving finger of the mechanism in accordance with the document DE 1 673 663, mounted pivotably on the date unlocking rocker in order to bring the driving lever away from and closer to the date disc by means of said sliding guide.

That mechanism provides an instantaneous date display and partially overcomes the problem which also arises from other similar mechanisms, namely that a manual correction of the time and/or of the date using the crown of the respective timepiece during "prohibited manual correction periods" could lead, depending on the exact circumstances, to a malfunction or even to damage of the date mechanism. However, it does not completely overcome this problem, because a manual correction is not possible during the instantaneous change of the date. In addition, guiding the trajectory of the driving lever of the mechanism in accordance with the document DE 10 2015 011 324 by sliding, which also occurs in the mechanism in accordance with the document DE 1 673 663, does not appear to be optimal. Furthermore, protecting the date disc against a double jump is always a problem with these mechanisms, given that the energy necessary to carry out the instantaneous jump of the date disc is released over a very short period of time and could cause, under some circumstances, an unwanted double jump. Similarly, the capture of torque by this type of mechanism from the horological movement of the respective timepiece is always delicate, as this capture of torque should be distributed over a maximum period of time, while allowing simultaneously for the instantaneous release of the accumulated energy, in order to minimize the influence on the chronometric performance of the horological movement.

Thus, there is still a need for the provision of an instantaneous date control device for horological date displays which overcomes the disadvantages and problems mentioned above.

SUMMARY OF THE INVENTION

The objective of the present invention is thus to overcome the disadvantages mentioned above of known devices and to provide an instantaneous date control device for horological date displays which allows, inter alia, to minimize the capture of torque from the horological movement of the respective timepiece, to provide effective protection of the date disc against a double jump, to provide a possibility of manual correction of the time and/or of the date with the aid of the crown of the respective timepiece, in particular to perform a time setting in the anticlockwise direction and a rapid correction of the date, without any restriction in time ranges, i.e. with no "prohibited manual correction periods", and without risk of damaging the device, as well as to provide an optimized trajectory for the moving parts during operation of the device. These objectives should be achieved along with ensuring a relatively low-bulk and modular construction, which should also be suitable for extra-thin movements, as well as a reliable operation of the device.

To this end, the present invention proposes an instantaneous date control device for a horological date display of the type mentioned above, in particular for a mechanical timepiece, as well as a horological movement, respectively a corresponding timepiece comprising a device of this type. In particular, in an instantaneous date control device in accordance with the present invention, the yoke mobile further comprises a pivot axis placed eccentrically on said second toothed wheel and the entirety of said unlocking and driving yoke is pivotably mounted about said pivot axis on said second toothed wheel in a manner such that said second toothed wheel allows to displace said pivot axis of the unlocking and driving yoke by rotation in a manner such as to place the driving finger of the unlocking and driving yoke behind a tooth of the date disc just before each instantaneous jump and to place it at the outer periphery of the trajectory of the teeth of the date disc after each instantaneous jump.

Thus, the instantaneous date device according to the present invention is designed in a manner such as to allow an instantaneous change in the date indication while ensuring a low capture of torque from the horological movement, due to the fact that the capture of torque is distributed over a maximum period during the day and that the accumulated energy is released instantaneously. In addition, replacing the sliding guide of the patent DE 10 2015 011 324 by a pivot axis placed eccentrically on the second toothed wheel of the device in accordance with the present invention, while disposing the unlocking and driving yoke on the second toothed wheel instead of placing it on a bridge, allows to optimize the trajectory of the various parts of the device.

In an embodiment of the device according to the present invention, the driving finger is disposed in a retractable manner with respect to the unlocking and driving yoke in order to permit the date to be corrected by a rapid date correction means of the respective timepiece. In particularly preferred embodiments of the device, the driving finger is formed either by a separate part pivotably mounted on the unlocking and driving yoke or by a flexible part mounted on or formed in one piece with the unlocking and driving yoke.

In another embodiment of the device according to the present invention, the unlocking and driving yoke comprises a biasing spring exerting a force on the driving finger, biasing it in its normal operating position into the direction of the teeth located on the date disc.

By these measures, effective protection of the date disc against a double jump is obtained along with the possibility of manual correction of the time and/or of the date with the aid of the crown or of a correcting pushbutton on the respective timepiece, in particular setting of the time in the anticlockwise direction and rapid correction of the date, without any restriction in time ranges and without the risk of damage, which leads to a particularly safe and reliable operation of this type of device. Furthermore, replacing the sliding guide of the patent DE 10 2015 011 324 by a pivot axis placed eccentrically on the second toothed wheel of the device according to the present invention while disposing the unlocking and driving yoke on the second toothed wheel instead of placing it on a bridge allows to realize an additional function which consists in separating the unlocking and driving force exerted by the unlocking and driving spring placed on a bridge and the biasing force exerted by the biasing spring disposed on the unlocking and driving yoke. Because of the presence of the sliding guide, this function is not feasible with a mechanism in accordance with the patent DE 10 2015 011 324. The unlocking and driving force of the unlocking and driving spring and the biasing force of the biasing spring typically do not have the same threshold, however, such that the presence of a biasing spring in the control device according to the present invention has the supplemental advantage of improving the ease of use, as be explained in more detail below.

In other embodiments of the device in accordance with the present invention, the first mobile and/or the second mobile of the device may be the subject of alternative arrangements, more specifically by using a unidirectional clutch means arranged either on the first toothed wheel or between the first toothed wheel and the cam. This provides a particularly advantageous solution, both as regards mounting of the cam on the first toothed wheel of the first mobile and as regards the relative movement between these parts.

Other characteristics as well as the corresponding advantages will become apparent from e dependent claims and from the description below describing the invention in more detail.

BRIEF DESCRIPTION OF THE DRAWINGS

The accompanying drawings schematically represent several embodiments of the invention by way of example.

DETAILED DESCRIPTION

The invention will now be described in detail with reference to the accompanying drawings illustrating, by way of example, several embodiments of the invention.

An instantaneous date control device according to the present invention is intended to be integrated into a timepiece equipped with a date display, in particular into a wristwatch provided with a mechanical horological movement. The device may also be used in a timepiece provided with a horological movement of another type, for example a quartz movement, such that the following comments are applicable in all these cases.

Figure 1A:
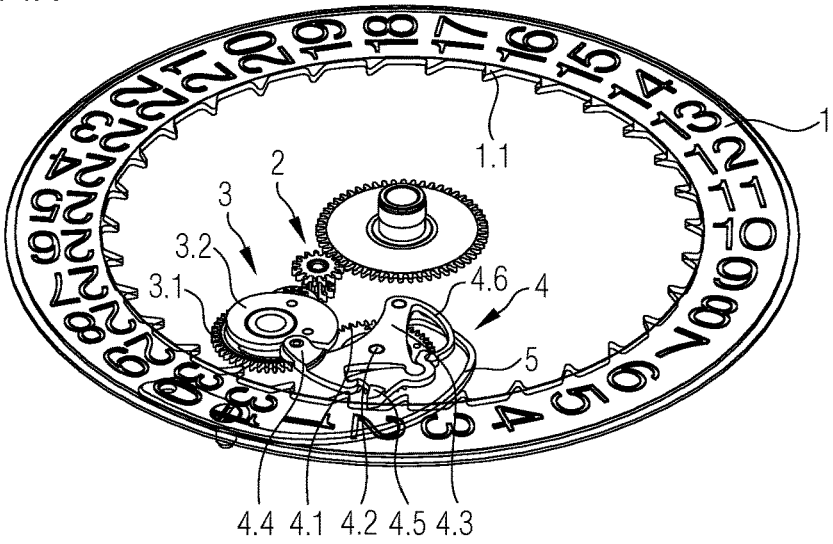
FIG. 1A shows a schematic perspective view of an instantaneous date control device for a date display of a timepiece according to the present invention.
Figure 1B:
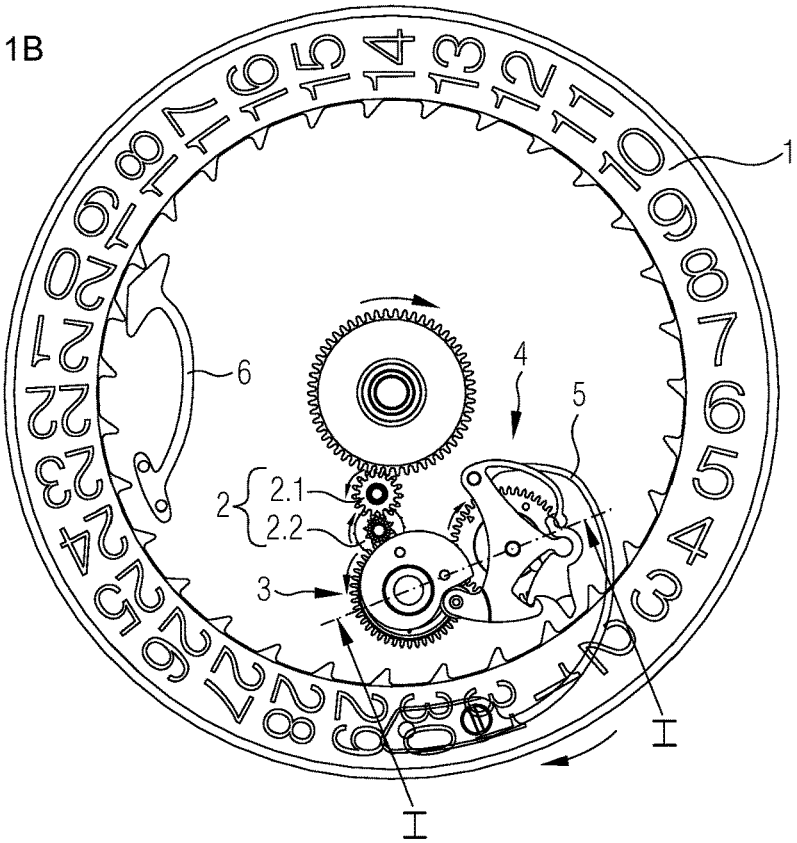
FIG. 1B is a top plan view of the device illustrated in FIG. 1A.
Figure 1C:
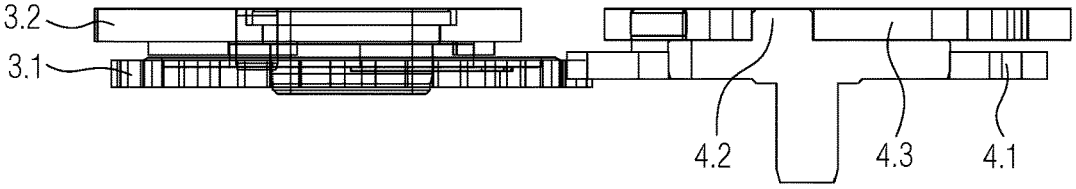
FIG. 1C shows a section through the device along the line I-I shown in FIG. 1B.

As illustrated schematically and by way of example in the perspective view of FIG. 1A, in the top plan view of FIGS. 1B and 1*n* the section of FIG. 1C, the device for instantaneous control of the date for a date display according to the present invention comprises a date disc 1, a gear train 2 forming a kinematic linkage between the instantaneous control device and a basic horological movement of the respective timepiece, a first mobile 3, namely the cam mobile, a second mobile 4, namely the yoke mobile, an unlocking and driving yoke 4.3, an unlocking and driving spring 5, and a retaining mechanism or means 6. In general, these components may be mounted on a bridge or a frame of the basic horological movement of the respective timepiece or, in the case of a modular construction, on a bridge or a frame of an instantaneous date module which can then be placed en bloc on the basic horological movement. Given that the structure and the function of the device are identical in both cases, the comments below are interchangeably applicable to these cases as well.

In order to describe each of these components in more detail, it should first be noted that although the horologist will typically use the term "date disc" 1, this latter is typically produced as a ring on which the date numbers from 1 to 31 are inscribed and which has an inner periphery provided with a series of teeth comprising a suitable number of teeth, normally 31 teeth. Preferably, in the control device according to the present invention, these teeth are realized as saw teeth which are more or less asymmetric. The gear train 2 which forms the kinematic linkage between the instantaneous control device and the basic horological movement of the respective timepiece may, as can for example be seen in FIGS. 1A and 1B, consist of a first intermediate pinion 2.1 driven by an hour wheel, shown in FIGS. 1A and 1B at the center of the date disc 1, and of a second intermediate pinion 2.2 which is meshed with the first intermediate pinion 2.1. The hour wheel turns clockwise at the rate of two turns per day, in a manner such that the first intermediate pinion 2.1 turns in the anticlockwise direction and the second intermediate pinion 2.2 turns in the clockwise direction, as indicated symbolically by the arrows in FIG. 1B. The first and second intermediate pins 2.1, 2.2 also act to reduce the speed in a manner such that the first and second mobiles 3, 4 turn at a speed of one turn per day.

The first mobile 3, namely the cam mobile, comprises a first toothed wheel 3.1 driven by said gear train 2 at a speed of one turn per day and a cam 3.2 mounted such as to be free to rotate, over a limited angular range and/or in a single direction of rotation, on said first toothed wheel 3.1 as well as temporarily coupled in rotation to said first toothed wheel 3.1, in a manner such that the cam 3.2 is driven by the first toothed wheel 3.1 in a discontinuous manner at a speed of one turn per day due to the fact that the cam is free to rotate in a limited angular range and/or in a single direction of rotation. As also indicated symbolically by an arrow in FIG. 1B, the first toothed wheel 3.1 and thus the cam normally turns in the anticlockwise direction.

The set of FIGS. 2A to 2C, 2D to 2F, 2G to 2I and 2J to 2L represent, each time in a perspective view, a top plan view and a cross section, four different embodiments of the first mobile of an instantaneous date control device in accordance with the present invention. In the first embodiment of the first mobile, illustrated in the set of FIGS. 2A to 2C, the cam 3.2 is mounted so as to be free to rotate over a limited angular range on said first toothed wheel 3.1 as well as temporarily coupled in rotation to said first toothed wheel 3.1 via a guide slot 3.1.1 substantially in the form of a semi-circular arc arranged on the first toothed wheel 3.1 as well as a pin 3.2.1 fixed on the cam and housed in said guide slot 3.1.1, or vice versa. In addition, said cam 3.2 is rotatably mounted on said first toothed wheel 3.1 about an axis of rotation 3.1.2 which is eccentric with respect to the axis of rotation of the first toothed wheel 3.1, said guide slot 3.1.1 substantially in the form of a semi-circular arc also being centered about said eccentric axis of rotation 3.1.2. Thus, when the first toothed wheel 3.1 is driven in the anticlockwise direction and the end of the guide slot 3.1.1 located in the clockwise direction abuts against the pin 3.2.1, the cam 3.2 is driven in the anticlockwise direction by the first toothed wheel 3.1, i.e. it is temporarily coupled in rotation to the first toothed wheel 3.1, while it can turn freely, in particular in the anticlockwise direction, over an angular range limited by the guide slot 3.1.1 in the form of a semi-circular arc, thus over an angular range of approximately 180°. The functions of this structure will become clearer in the remainder of the description, in particular when the operation of the device is described.

Figure 2A:
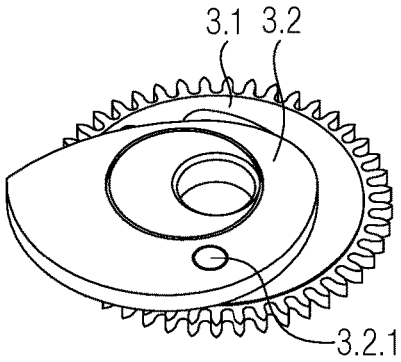
FIGS. 2A to 2C schematically represent a perspective view, a top plan view and a section through the device along the line II-II shown in FIG. 2B of a first embodiment of the first mobile of an instantaneous date control device according to the present invention.
Figure 2D:
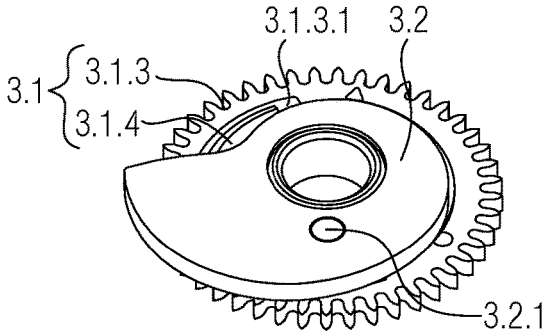
FIGS. 2D to 2F schematically represent a perspective view, a top plan view and a section through the device along the line shown in FIG. 2E of a second embodiment of the first mobile of an instantaneous date control device according to the present invention.
Figure 2B:
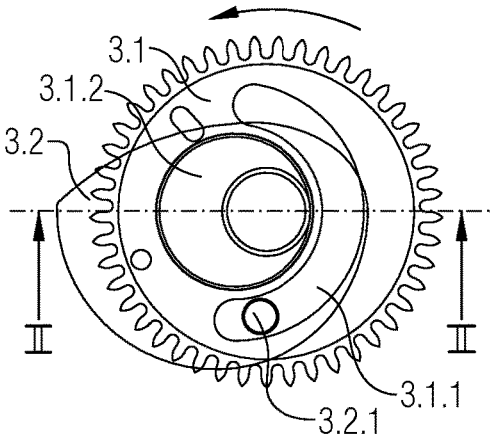
Figure 2E:
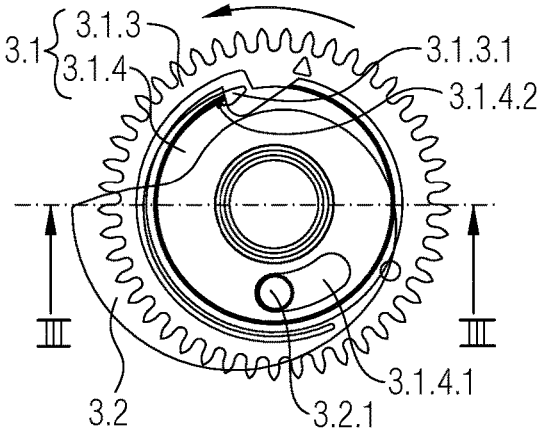
Figure 2C:
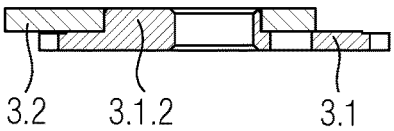
Figure 2F:
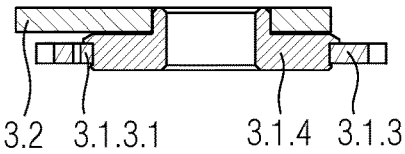

In the second embodiment of the first mobile, illustrated in the set of FIGS. 2D to 2F, the cam 3.2 is freely rotatably mounted on said first toothed wheel 3.1 over a limited angular range as well as temporarily coupled in rotation to said first toothed wheel 3.1 via a guide slot 3.1.4.1 substantially in the form of a sector of a circular arc arranged on the first toothed wheel 3.1, this sector preferably having an angular extent which is located in the range from 25° to 65°, as well as a pin 3.2.1 fixed on the cam and housed in said guide slot 3.1.4.1, or vice versa. In addition, the first toothed wheel 3.1 is separated into two parts, namely into a ring 3.1.3 of the first toothed wheel driven in the anticlockwise direction by said gear train 2 and into a disc 3.1.4 of the first toothed wheel. The disc 3.1.4 comprises said guide slot 3.1.4.1 and is housed inside the ring 3.1.3 so as to be freely rotatable, but kinematically linked to the ring 3.1.3 via a unidirectional clutch means arranged on these two parts 3.1.3, 3.1.4 of the first toothed wheel 3.1. In particular, the ring 3.1.3 comprises a hook 3.1.3.1 of the unidirectional clutch mechanism or means and the disc 3.1.4 comprises a corresponding driving shoulder 3.1.4.2 of the unidirectional clutch means, in a manner such that driving the ring 3.1.3 in the anticlockwise direction also causes the disc 3.1.4 of the first toothed wheel 3.1 to be driven as soon as the hook 3.1.3.1 of the ring 3.1.3 comes into contact with the driving shoulder 3.1.4.2 of the disc 3.1.4. Driving the ring 3.1.3, i.e. the first toothed wheel 3.1, in the clockwise direction causes disengagement of the unidirectional clutch means in a manner such that the disc 3.1.4 is not driven in this case. In this embodiment, the cam 3.2 is mounted in a rotational manner on said first toothed wheel 3.1 coaxially with respect to the axis of rotation of the first toothed wheel 3.1. Thus, when the first toothed wheel 3.1 is driven in the anticlockwise direction and the end situated in the clockwise direction of the guide slot 3.1.4.1 abuts against the pin 3.2.1, the cam 3.2 is driven by the first toothed wheel 3.1 in the anticlockwise direction, i.e. it is temporarily coupled in rotation to the first toothed wheel 3.1, while it can turn freely, in particular in the anticlockwise direction, over an angular range limited by the guide slot 3.1.4.1 in the form of a circular arc sector, thus over an angular range of approximately 25° to 65°. Without considering the other parts of the device, the cam 3.2 could even turn, in the anticlockwise direction and because of the presence of the unidirectional clutch means, completely freely with respect to the ring 3.1.3, but drives the disc 3.1.4 when the relative rotation between the cam 3.2 and the disc 3.1.4 exceeds the angular range limited by the guide slot 3.1.4.1 on the disc 3.1.4. In this case, because of the disengagement of the unidirectional clutch means, the rotation of the disc 3.1.4 in the anticlockwise direction does not cause rotation of the ring 3.1.3.

Figure 2G:
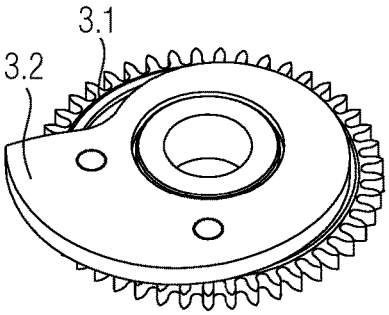
FIGS. 2G to 2I schematically represent a perspective view, a top plan view and a section through the device along the line IV-IV shown in FIG. 2H of a third embodiment of the first mobile of an instantaneous date control device according to the present invention.
Figure 2J:
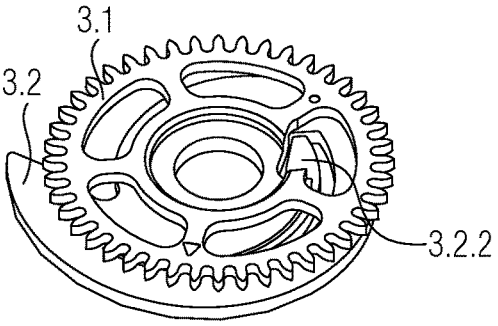
FIGS. 2J to 2L schematically represent a perspective view, a top plan view and a section through the device along the line V-V shown in FIG. 2K of a fourth embodiment of the first mobile of an instantaneous date control device according to the present invention; some parts are illustrated in transparent view in these figures.
Figure 2H:
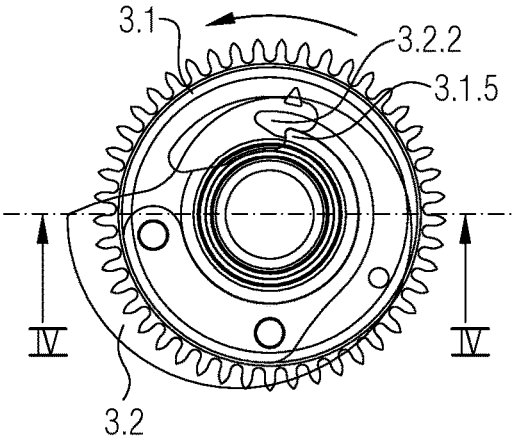
Figure 2K:
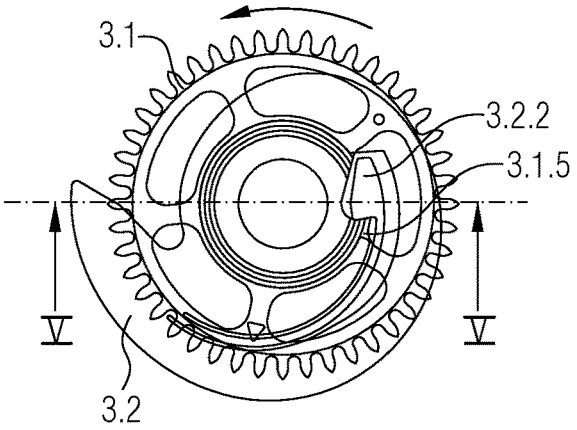
Figure 2I:
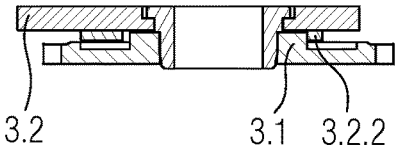

In the third embodiment of the first mobile, illustrated in the set of FIGS. 2G to 2I and also in FIGS. 1A to 1C, the cam 3.2 is mounted on said first toothed wheel 3.1 so as to be freely rotatable in a single direction of rotation and also is temporarily coupled in rotation to said first toothed wheel 3.1 via a unidirectional clutch means 3.1.5, 3.2.2 arranged between the first toothed wheel 3.1 and the cam 3.2. In this regard, the first toothed wheel 3.1 comprises a driving shoulder 3.1.5 of the unidirectional clutch means and the cam 3.2 comprises a corresponding hook 3.2.2 of the unidirectional clutch means in a manner such that driving the first toothed wheel 3.1 in the anticlockwise direction also causes the cam 3.2 to be driven as soon as the driving shoulder 3.1.5 of the first toothed wheel 3.1 comes into contact with the hook 3.2.2 of the cam 3.2, while driving the first toothed wheel 3.1 in the clockwise direction causes a disengagement of the unidirectional clutch means in a manner such that the cam 3.2 is not driven in this rotational direction. In this embodiment as well, the cam 3.2 is rotatably mounted on said first toothed wheel coaxially with respect to the axis of rotation of the first toothed wheel 3.1. Thus, when the first toothed wheel 3.1 is driven in the anticlockwise direction, the cam 3.2 is driven by the first toothed wheel 3.1 in the anticlockwise direction, i.e. it is temporarily coupled in rotation to the first toothed wheel 3.1, as soon as the driving shoulder 3.1.5 of the first toothed wheel 3.1 comes into contact with the hook 3.2.2 of the cam 3.2, and the cam 3.2 can turn freely, without considering the other parts of the device, in the anticlockwise direction, also because of the disengagement of the unidirectional clutch mechanism 3.1.5, 3.2.2.

Figure 2L:
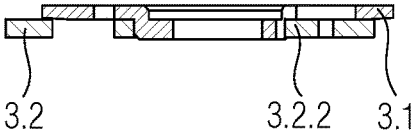

In the fourth embodiment of the first mobile, illustrated in the set of FIGS. 2J to 2L, the cam 3.2 is also mounted such as to be freely rotatable on said first toothed wheel 3.1 in a single direction of rotation as well as temporarily coupled in rotation to said first toothed wheel 3.1 via a unidirectional clutch means 3.1.5, 3.2.2 arranged between the first toothed wheel 3.1 and the cam 3.2. This embodiment therefore has the same construction principle as the third embodiment of the first mobile, but by having a minimal height, it is specifically adapted to integration into extra-thin movements, as can be seen in particular in FIG. 2L.

The second mobile 4, the yoke mobile, comprises a second toothed wheel 4.1 driven via said first toothed wheel 3.1 at a speed of one turn per day. As indicated symbolically by an arrow in FIG. 1B, the direction of rotation of the second toothed wheel 4.1 of the second mobile 4 is opposite to that of said first toothed wheel 3.1 of the first mobile 3. Preferably, the second toothed wheel 4.1 is driven directly by the first toothed wheel 3.1, but it is evidently possible to provide intermediate wheels ensuring a suitable kinematic linkage between the first toothed wheel 3.1 and the second toothed wheel 4.1.

The unlocking and driving yoke 4.3 carries a feeler 4.4 bearing on said cam 3.2 mounted on the first toothed wheel 3.1 of the first mobile 3 and acting as an unlocking finger as well as providing the angular orientation of the unlocking and driving yoke 4.3 with respect to the other parts of the device. Said unlocking and driving yoke 4.3 also carries a driving finger 4.5 which can engage with the teeth 1.1 located on the date disc 1 in order to drive the latter step by step. In addition, said unlocking and driving yoke 4.3 carries a hinging mechanism or means 4.7, for example a pin, onto which applies the unlocking and driving spring 5.

The unlocking and driving spring 5 is mounted on a bridge or the frame of the respective timepiece, or even of an instantaneous date module, and exerts on said hinging means 4.7 of the unlocking and driving yoke 4.3 a biasing force which is adapted to apply the feeler 4.4 against the cam 3.2 of the first mobile 3. The unlocking and driving spring 5 stores sufficient energy to guarantee an instantaneous jump of the date disc 1.

The retaining means 6, shown only symbolically in FIG. 1B and realized for example by a jumper or any other suitable elastic means, allows to secure the angular position of the date disc 1 between two instantaneous jumps. The bearing force exerted by the retaining means 6 is chosen in a manner such that the date disc 1 cannot jump under the effect of an external shock but, however, allows one single instantaneous jump of the date disc 1 under the effect of said driving finger 4.5 as well as of any optional rapid correction of the date. The elasticity of the driving finger 4.5 of the unlocking and driving yoke 4.3 is an optional safety measure.

The instantaneous control device according to the present invention is distinguished in particular by the fact that the yoke mobile 4 further comprises a pivot axis 4.2 placed in an eccentric manner on said second toothed wheel 4.1. The entirety of said unlocking and driving yoke 4.3 is pivotably mounted about this pivot axis 4.2 on said second toothed wheel 4.1, such that said second toothed wheel 4.1 can displace said pivot axis 4.2 of the unlocking and driving yoke 4.3 by rotation in a manner such as to place the driving finger 4.5 of the unlocking and driving yoke 4.3 behind a tooth 1.1 of the date disc 1 just before each instantaneous jump and to place it at the outer periphery of the trajectory of the teeth 1.1 of the date disc 1 after each instantaneous jump. Simultaneously, the cooperation between the first toothed wheel 3.1, the cam 3.2 mounted on said first toothed wheel 3.1 and the feeler 4.4 of the unlocking and driving yoke 4.3 allows to charge the unlocking and driving spring 5 when the unlocking and driving yoke 4.3 is moved away, respectively its driving finger 4.5 is placed beyond the trajectory of the teeth 1.1 of the date disc 1, as well as to release, in an instantaneous manner, the energy accumulated by the unlocking and driving spring 5 when the unlocking and driving yoke 4.3 is moved closer, respectively its driving finger 4.5 is momentarily placed behind a tooth 1.1 of the date disc 1, in order to cause a change of the position of the date disc 1 by means of an instantaneous jump.

Preferably, this driving finger 4.5 is disposed in a retractable manner with respect to the unlocking and driving yoke 4.3 in order to allow the date to be corrected by a rapid date correction means of the corresponding timepiece. In this regard, the driving finger 4.5 may be formed by a separate part mounted on the unlocking and driving yoke 4.3 in a pivotable manner, as illustrated schematically and by way of example in FIGS. 1A and 1B, 3A and 3B as well as 3D and 3E.

Figure 3A:
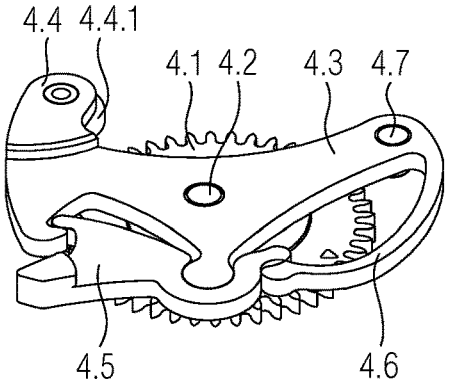
FIGS. 3A to 3C represent a schematic perspective view, a top plan view and a section through the device along the line VI-VI shown in FIG. 3B of a first embodiment of the second mobile of an instantaneous date control device according to the present invention, with some parts in these figures being illustrated in transparent view for better comprehension.
Figure 3D:
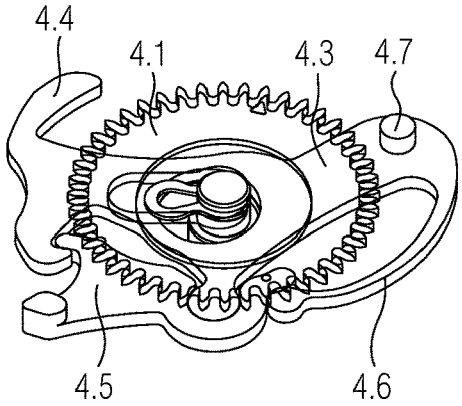
FIGS. 3D to 3F represent a schematic perspective view, a top plan view and a section through the device along the line VII-VII shown in FIG. 3E of a second embodiment of the second mobile of an instantaneous date control device according to the present invention, with some parts in these figures also being illustrated in transparent view for better comprehension.
Figure 3B:
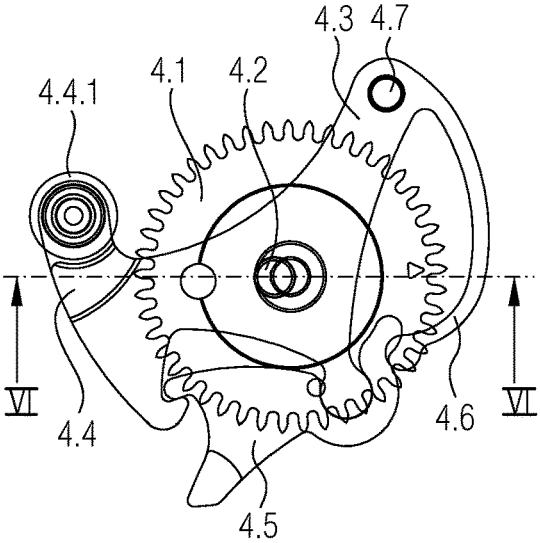
Figure 3E:
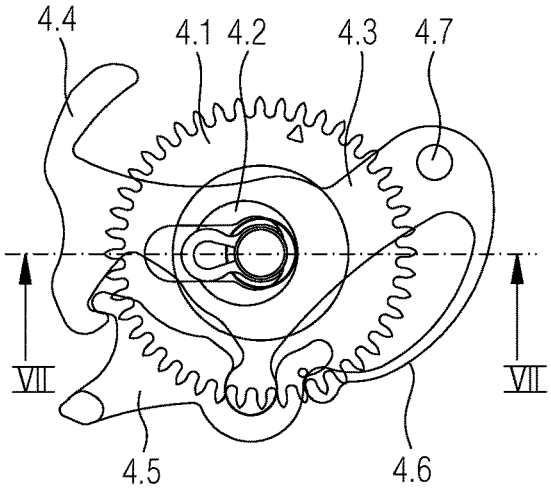
Figure 3C:
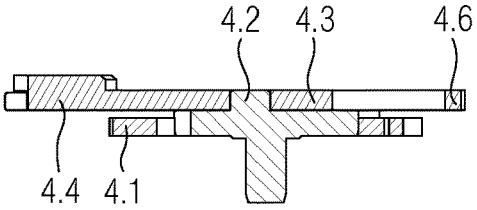
Figure 3F:
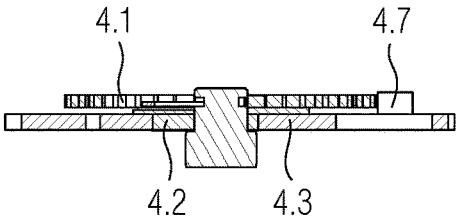
Figure 3G:
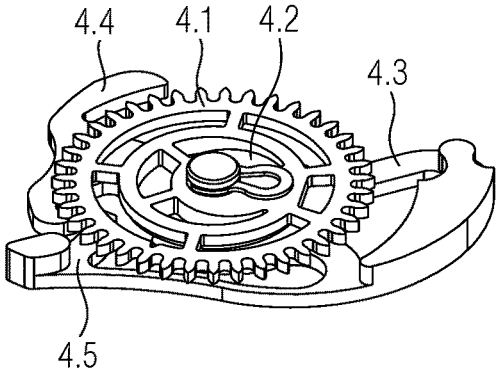
FIGS. 3G to 3I represent a schematic perspective view, a top plan view and a section through the device along the line VIII-VIII shown in FIG. 3H of a third embodiment of the second mobile of an instantaneous date control device according to the present invention, with some parts in these figures also being illustrated in transparent view for better comprehension.
Figure 3J:
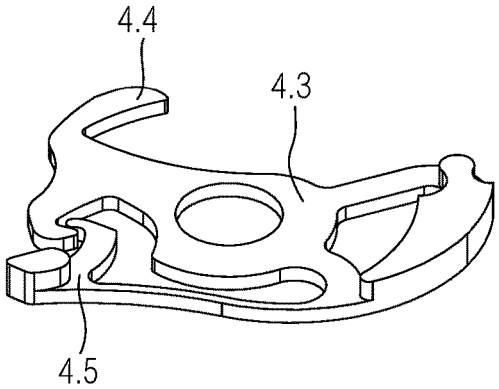
FIGS. 3J and 3K represent a schematic perspective view and a top plan view of the unlocking and driving yoke of the third embodiment of the second mobile of an instantaneous control device according to the present invention.
Figure 3H:
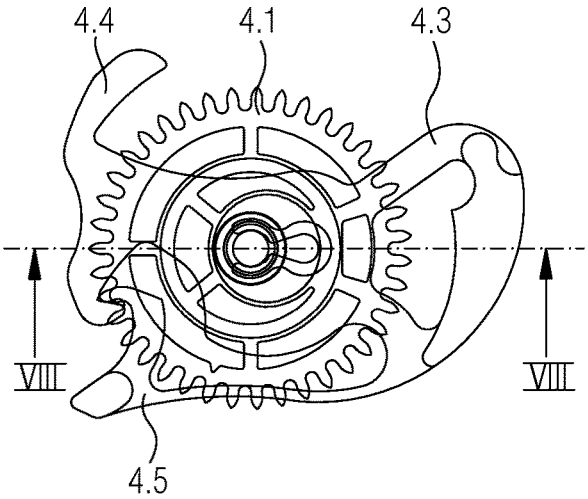
Figure 3K:
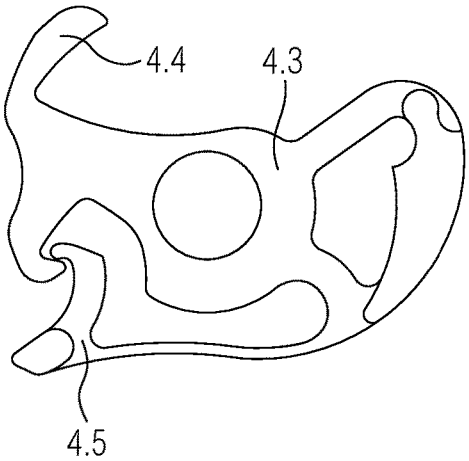
Figure 3I:
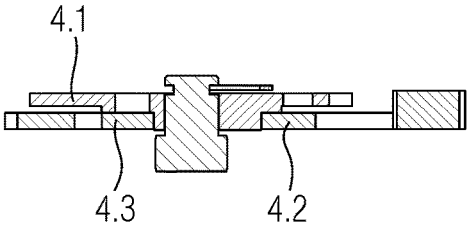

Alternatively, the driving finger 4.5 may be formed by a flexible part mounted on or formed in one piece with the unlocking and driving yoke 4.3, as illustrated schematically and by way of example in FIGS. 3G and 3H as well as 3J and 3K. In all cases, the driving finger 4.5 may be equipped with an abutment cooperating with a limiting shoulder disposed on the unlocking and driving yoke 4.3 in a manner such as to limit pivoting of the driving finger 4.5 to a desired angular range, as can also be seen in FIGS. 1A and 1B, 3A and 3B, 3D and 3E as well as 3G and 3H.

Furthermore, as also illustrated by way of example in FIGS. 1A and 1B as well as 3A to 3C which show a first preferred embodiment of the unlocking and driving yoke 4.3, this yoke 4.3 particularly preferably and advantageously comprises a biasing spring 4.6 exerting a biasing force on the driving finger 4.5 which biases it in the direction of the teeth 1.1 located on the date disc 1. The biasing force of the biasing spring 4.6 on the unlocking and driving yoke 4.3 is chosen in a manner such as to be able to secure, in cooperation with the retaining means 6, the angular position of the date disc 1 just after each instantaneous jump, in order to avoid any accidental displacement of the date disc 1, as will become clearer from the remainder of the description. In this embodiment of the unlocking and driving yoke 4.3, the feeler 4.4 located on the unlocking and driving yoke 4.3 is also equipped with a small wheel 4.4.1 mounted idle on the free end of said feeler 4.4 in order to reduce the friction between the feeler 4.4 of the yoke 4.3 and the cam 3.2 of the first mobile 3. FIGS. 3D to 3F show a second embodiment of the unlocking and driving yoke 4.3 which is not provided with a small wheel on the feeler 4.4, but which has a minimal height and is thus specifically adapted to integration into extra-thin movements, as can be seen in particular in FIG. 3F.

FIGS. 3G to 3K show a third embodiment of the unlocking and driving yoke 4.3 which is equipped with a driving finger 4.5 formed as one piece with the yoke 4.3. In order to machine this monobloc variant, the various portions of the unlocking and driving yoke 4.3 cannot be in physical contact. In this design, there is thus no biasing which urges the driving finger 4.5 against the limiting shoulder disposed on the unlocking and driving yoke 4.3. The finger contacts this limiting shoulder only during the jump, under the effect of the force to be supplied in order to displace the date disc. Similarly, this embodiment is specifically designed for integration into extra-thin movements.

The components described above of the various embodiments of an instantaneous date control device according to the present invention may be fabricated using traditional means, such as milling, cutting, die stamping, turning and/or electrochemical processes, but they may also be fabricated with the aid of non-traditional materials and processes, such as silicon machined by a Deep Reactive Ion Etching (DRIE) process, nickel machined by electroforming, for example using the UV-Liga process, or by 3D printing.

In light of the detailed description figuring above of the structure of the components of the various embodiments of an instantaneous date control device according to the present invention, the operation of the device is readily comprehensible with the aid of FIGS. 4A to 4G which, schematically and using top views similar to that of FIG. 1B but illustrating only a part of the date disc 1, show seven steps during the operation of a device of this type.

In fact, during the normal operation of a timepiece comprising such an instantaneous date control device, the hour wheel of the basic horological movement of this timepiece drives the gear train 2 which in turn causes the first toothed wheel 3.1 to turn at a speed of one turn per day in the anticlockwise direction. The cam 3.2, mounted on the first toothed wheel 3.1 and because of its rotational freedom in a limited angular range and/or in a single direction of rotation, is then driven in a discontinuous manner at a speed of one turn per day in the anticlockwise direction, as explained above with respect to the various embodiments of the first mobile 3. The unlocking and driving yoke 4.3, with its feeler 4.4 applied against the peripheral spiral surface of the cam 3.2, then charges the unlocking and driving spring 5. Simultaneously, the first toothed wheel 3.1 causes the second toothed wheel 4.1 of the second mobile 4 to turn at a speed of one turn per day in the clockwise direction, such as to displace said pivot axis 4.2 of the unlocking and driving yoke 4.3 by rotation and thus to place the driving finger 4.5 of the unlocking and driving yoke 4.3 behind a tooth of the date disc 1 just before each instantaneous jump and to place it at the outer periphery of the trajectory of the teeth of the date disc 1 after each instantaneous jump. An instantaneous jump of the date disc 1 occurs when the feeler 4.4 of the unlocking and driving yoke 4.3 arrives at the steep flank, which is in fact almost radial, of the cam 3.2 and, with the aid of the energy accumulated by the unlocking and driving spring 5 which is sufficient to guarantee an instantaneous jump of the date disc 1, causes the cam 3.2 to advance in an instantaneous manner in the anticlockwise direction. The cam 3.2 then is in, and temporarily remains in, an angular position which is advanced with respect to the first toothed wheel 3.1, this being made possible because of the guide slot 3.1.1, 3.1.4.1 and/or because of the unidirectional clutch means disposed on the two parts 3.1.3, 3.1.4 of the first toothed wheel 3.1, respectively between the first toothed wheel 3.1 and the cam 3.2 of the first mobile 3. The continuous driving by the hour wheel and the gear train 2 then causes the advance of the first toothed wheel 3.1 until the cam 3.2 is again temporarily coupled in rotation with this first toothed wheel 3.1, such that the cycle recommences.

Figure 4A:
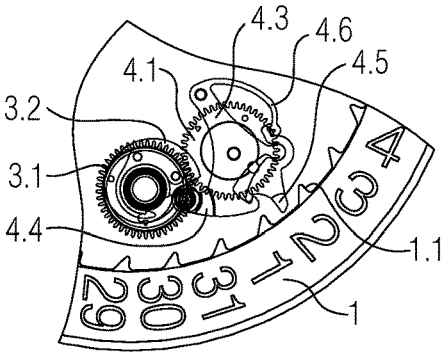
FIGS. 4A to 4G schematically show by way of example, by means of top views similar to FIG. 1B but only showing part of the date disc, seven steps during the operation of an instantaneous control device according to the present invention, namely different positions when the unlocking and driving spring of the device is loaded and the position just before the instantaneous change of the date disc.
Figure 4B:
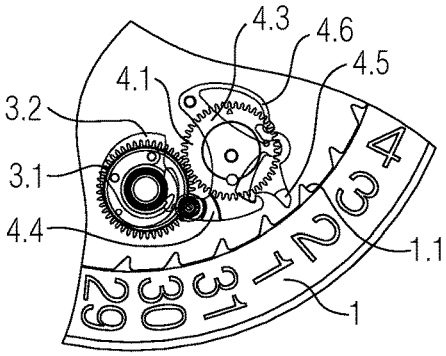
Figure 4C:
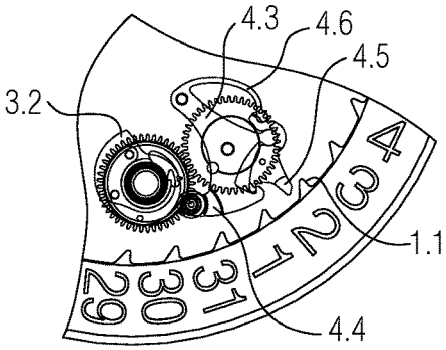
Figure 4D:
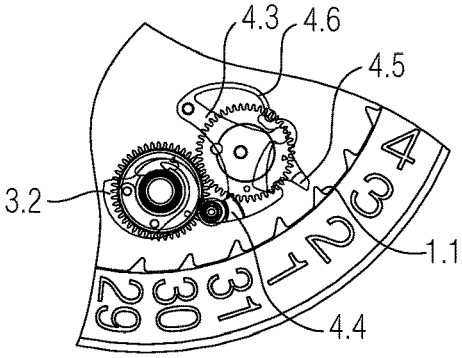
Figure 4E:
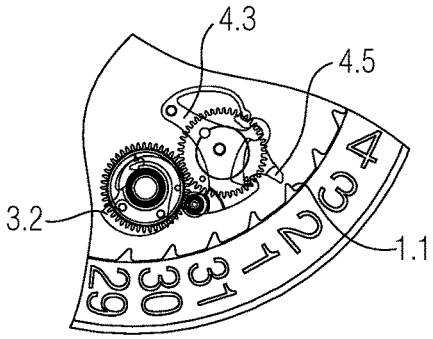
Figure 4F:
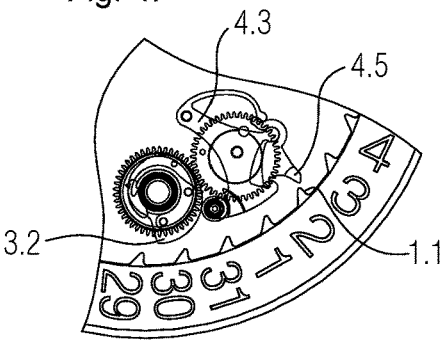
Figure 4G:
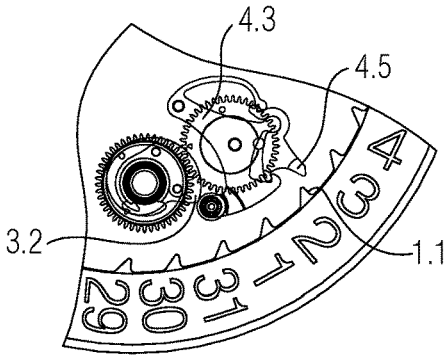

This sequence of movements is illustrated schematically in FIGS. 4A to 4F, which show different successive positions of the components of the instantaneous control device when the cooperation between the cam 3.2 and the unlocking and driving yoke 4.3 charges the unlocking and driving spring 5, as well as in FIG. 4G, which shows the position of the components just before the instantaneous jump of the date disc 1. In particular, FIGS. 4A to 4F, wherein FIG. 4A shows the position of the components just after the instantaneous jump of the date disc 1, reveal that the rotation of said eccentric pivot axis 4.2 of the unlocking and driving yoke 4.3 allows to place the driving finger 4.5 of the unlocking and driving yoke 4.3 behind a tooth of the date disc 1 just before each instantaneous jump and to place it at the outer periphery of the trajectory of the teeth of the date disc 1 some time after each instantaneous jump. In fact, while being brought to the rear, the driving finger 4.5 remains between two teeth 1.1 of the date disc 1 during the operational steps of the device illustrated in FIGS. 4A to 4C, then is moved gradually away from the teeth, respectively, from the date disc 1, as can be seen in FIGS. 4D and 4E, to then be positioned behind the next tooth 1.1 of the date disc 1 which will then be involved in the next instantaneous switch, as can be seen in FIGS. 4F and 4G. It remains to be noted in this context that the fact that the driving finger 4.5 remains temporarily between two teeth of the date disc 1 following each instantaneous jump produces a supplemental advantage for an instantaneous control device in accordance with the present invention. In fact, the biasing spring 4.6, the primary function of which is to exert a biasing force on the driving finger 4.5 to bias it in the direction of the teeth 1.1 located on the date disc 1, can then also be provided with the secondary function of securing, in cooperation with the retaining means 6, the angular position of the date disc 1 just after each instantaneous jump, in order to prevent an accidental displacement of the date disc 1, in particular in order to prevent any accidental double jump. As mentioned above, the biasing force of this biasing spring 4.6 on the unlocking and driving yoke 4.3 in this case s selected in a corresponding manner, amongst others as a function of the layout of the retaining means 6.

When the user of a timepiece comprising an instantaneous date control device of this type adjusts the time by backwards handsetting, i.e. by turning backwards the setting crown of the respective timepiece with the setting crown being in its setting position, the hour wheel, the gear train 2, the first toothed wheel 3.1 as well as the second toothed wheel 4.1 are driven in the opposite rotational direction to that indicated symbolically by the arrows in FIG. 1B. However, this only corrects the time, but does not have any influence on the date disc 1. In fact, as explained in more detail above during the description of the structure of the four embodiments of the first mobile 3, the arrangement of the first mobile 3 guarantees that during backwards rotation of the first and second mobiles 3, 4, the driving finger 4.5 does not touch a tooth 1.1 of the date disc 1 at any time, in the first embodiment of the first mobile 3, this is possible because of the guide slot 3.1.1 substantially in the form of a semicircular arc and the eccentric axis of rotation 3.1.2 on the first toothed wheel 3.1 as well as due to the corresponding shape of the peripheral surface of the cam 3.2, which have the effect that the cooperation between the cam 3.2 and the unlocking and driving yoke 4.3 during a backwards correction produces a trajectory of the driving finger 4.5 which remains out of contact with the teeth 1.1 of the date disc 1. In the other embodiments of the first mobile 3, this is made possible by means of the unidirectional clutch means arranged either on the first toothed wheel 3.1 or between the first toothed wheel 3.1 and the cam 3.2. In fact, a backwards correction in these embodiments of the first mobile 3 simply results in a disengagement of the unidirectional clutch means, such that the cam 3.2 is not driven and that a rotation of the unlocking and driving yoke 4.3 during a backwards correction produces a trajectory of the driving finger 4.5 which remains out of contact with the teeth 1.1 of the date disc 1. Furthermore, in the first embodiment of the first mobile 3, the cam 3.2 has a much less pronounced slope on its portion forming the drop of the cam in order to allow the feeler 4.4 of the unlocking and driving yoke 4.3 to climb this ramp during a backwards correction, which causes the unlocking and driving spring 5 to be cocked. In the other embodiments of the first mobile 3, the portion forming the drop of the cam may have a steeper slope because the disengagement of the unidirectional clutch means prevents cocking of the unlocking and driving spring 5 during a backwards correction, which at the same time results in a longer loading sector on the cam 3.2, thus in a better distribution of the capture of torque.

Finally, when the user of a timepiece comprising an instantaneous control device of this type makes a rapid date correction, i.e. by turning the setting crown of the respective timepiece in the normal direction with the setting crown being in its rapid date correction position, a correction train wheel, not shown in the figures, acts directly on the date disc 1 and causes its rotation in the clockwise direction. However, this has no influence on the instantaneous control device according to the present invention, because on the one hand the driving finger 4.5 of the unlocking and driving yoke 4.3 in this control device is lifted from the trajectory of the teeth 1.1 of the date disc 1 much earlier each day, namely typically between 4 o'clock and 7 o'clock in the morning, than in prior art instantaneous date mechanisms in which this can only occur each day in the afternoon or evening. On the other hand, in the case in which a rapid date correction is carried out when the driving finger 4.5 of the unlocking and driving yoke 4.3 is still in the trajectory of the teeth 1.1 of the date disc 1, this again has no influence because the driving finger 4.5 is arranged in a retractable manner with respect to the unlocking and driving yoke 4.3 and thus, if required, can be retracted to allow the teeth 1.1 of the date disc 1 to pass by during a rapid date correction. The biasing spring 4.6 on the unlocking and driving yoke 4.3 thus even has a third function, namely to allow rapid date correction at any time without damaging the device. In addition, the separation of the unlocking and driving force exerted by the unlocking and driving spring 5 placed on the frame or a bridge of the timepiece, or of an instantaneous control module, and of the biasing force exerted by the biasing spring 4.6 arranged on the unlocking and driving yoke 4.3 allows to improve the ease of use, because these forces typically do not have the same threshold and the user will, in a control device according to the present invention, only notice a retaining force which is much lower than in prior art mechanisms when wishing to make a rapid date correction.

The present invention also concerns a movement and a timepiece comprising an instantaneous control device of this type which, without it being necessary to describe in every detail, are within the purview of the person skilled in the art provided with the technical teaching of the present description. Preferably, the timepiece is a wristwatch equipped with a mechanical horological movement.

In light of the detailed description given above of both the structure and the function of the various embodiments of the instantaneous date control device in accordance with the present invention, it is also clear to the person skilled in the art that this device has many advantages compared with prior art date mechanisms. On the one hand, the instantaneous date device according to the present invention allows to carry out an instantaneous change of the date indicated while guaranteeing a small capture of torque from the horological movement, given that the capture of torque is distributed over a maximum period during the day and that the accumulated energy is released instantaneously. On the other hand, the eccentric position of the pivot axis on the second toothed wheel of the device according to the present invention while positioning the entirety of the unlocking and driving yoke on the second toothed wheel optimizes the trajectory of the various parts of the device. In addition, the device is provided with an effective protection of the date disc against a double jump as well as with the possibility of manually setting the time and/or the date with the aid of the crown of the corresponding timepiece, in particular setting the time in the anticlockwise direction and/or rapid correction of the date, without any restriction to time ranges and without the risk of damage. All of these properties result in a particularly safe and reliable operation of the device. Furthermore, the instantaneous date device according to the present invention is more comfortable to use because of the separation of the unlocking and driving force exerted by the unlocking and driving spring placed on the frame or a bridge and of the biasing force exerted by the biasing spring arranged on the unlocking and driving yoke. These advantages are obtained while guaranteeing a relatively low-bulk construction which is also modular, such that an instantaneous date device in accordance with the present invention is also suitable for extra-thin movements. Finally, several variants of the device are available, making it flexible in use.

LIST OF REFERENCE NUMERALS

| No. | Element of the device according to the invention |
|---|---|
| 1 | date disc |
| 2 | reduction gear train |
| 3 | first mobile |
| 3.1 | first toothed wheel |
| 3.1.1 | guide slot |
| 3.1.2 | eccentric axis of rotation |
| 3.1.3 | ring of first toothed wheel |
| 3.1.3.1 | hook of unidirectional clutch mechanism |
| 3.1.4 | disc of first toothed wheel |
| 3.1.4.1 | guide slot |
| 3.1.4.2 | driving shoulder |
| 3.1.5 | driving shoulder |
| 3.2 | cam |
| 3.2.1 | pin |
| 3.2.2 | hook of unidirectional clutch mechanism |
| 4 | second mobile |
| 4.1 | second toothed wheel |
| 4.2 | pivot axis |
| 4.3 | unlocking yoke |
| 4.4 | feeler |
| 4.5 | driving finger |
| 4.6 | biasing finger |
| 4.7 | hinging mechanism |
| 5 | unlocking and driving spring |
| 6 | retaining mechanism |

The invention claimed is:

1. An instantaneous date control device for a date display of a timepiece, the control device comprising:

a date disc, a gear train forming a kinematic linkage between the control device and a horological movement of said timepiece, a cam mobile, comprising:

a first toothed wheel driven by said gear train at a speed of one turn per day, and a cam mounted freely rotatably, over a limited angular range and/or in a single direction of rotation, on the first toothed wheel as well as temporarily coupled in rotation to said first toothed wheel, in a manner such that the cam is driven by said first toothed wheel, because of its rotational freedom over an angular range and/or in a single direction of rotation, in a discontinuous manner at a speed of one turn per day, a yoke mobile, comprising a second toothed wheel driven via said first toothed wheel at a speed of one turn per day, an unlocking and driving yoke carrying:

a feeler bearing on said cam mounted on said first toothed wheel and acting as an unlocking finger, and a driving finger configured to come into engagement with teeth located on the date disc, an unlocking and driving spring mounted on a frame of the corresponding timepiece and exerting on said unlocking and driving yoke a biasing force which is adapted to apply the feeler against the cam as well as to store sufficient energy to guarantee an instantaneous jump of the date disc, and a retaining means allowing to secure the angular position of the date disc between two instantaneous jumps, wherein the yoke mobile further comprises:

a pivot axis placed eccentrically on said second toothed wheel, the entirety of said unlocking and driving yoke being mounted pivotably about said pivot axis on said second toothed wheel, such that said second toothed wheel enables displacement of said pivot axis of the unlocking and driving yoke by rotation in a manner such as to place the driving finger of the unlocking and driving yoke behind a tooth of the date disc just before each instantaneous jump and to place the driving finger of the unlocking and driving yoke at the outer periphery of the trajectory of the teeth of the date disc after each instantaneous jump.

2. The device according to claim 1, wherein the driving finger is arranged in a retractable manner with respect to the unlocking and driving yoke in order to allow the date to be corrected via a rapid date correction means of the corresponding timepiece.

3. The device according to claim 1, wherein the driving finger is formed by a separate part pivotably mounted on the unlocking and driving yoke.

4. The device according to claim 1, wherein the driving finger is formed by a flexible part mounted on or formed in one piece with the unlocking and driving yoke.

5. The device according to claim 1, wherein the unlocking and driving yoke comprises a biasing spring exerting a biasing force on the driving finger biasing it in the direction of the teeth located on the date disc.

6. The device according to claim 5, wherein the biasing force of the biasing spring on the unlocking and driving yoke is selected such as to be adapted to secure, in cooperation with the retaining means, the angular position of the date disc just after each instantaneous jump, in order to prevent any accidental displacement of the date disc.

7. The device according to claim 1, wherein the feeler located on the unlocking and driving yoke is equipped with a small wheel.

8. The device according to claim 1, wherein the cam is mounted on said first toothed wheel in a freely rotatable manner, over a limited angular range, as well as temporarily coupled in rotation to said first toothed wheel via a guide slot substantially in the form of a semi-circular arc on the first toothed wheel and a pin on the cam housed in said guide slot, or said guide slot substantially in the form of the semi-circular arc on the cam and the pin on the first toothed wheel in said guide slot, said cam being rotatably mounted on said first toothed wheel about an axis of rotation which is eccentric with respect to the axis of rotation of the first toothed wheel.

9. The device according to claim 1, wherein the cam is mounted on said first toothed wheel in a freely rotatable manner, over a limited angular range, as well as temporarily coupled in rotation to said first toothed wheel via a guide slot substantially in the form of a sector of a circular arc on the first toothed wheel and a pin on the cam housed in said guide slot, or said guide slot substantially in the form of a sector of a circular arc on the cam and the pin on the first toothed wheel housed in said guide slot, as well as a unidirectional clutch mechanism arranged on the first toothed wheel, said cam being rotatably mounted on said first toothed wheel coaxially with respect to the axis of rotation of the first toothed wheel.

10. The device according to claim 1, wherein the cam is mounted on said first toothed wheel in a freely rotatable manner, in a single direction of rotation, as well as temporarily coupled in rotation to said first toothed wheel via a unidirectional clutch mechanism arranged between the first toothed wheel and the cam, said cam being rotatably mounted on said first toothed wheel coaxially with respect to the axis of rotation of the first toothed wheel.

11. The device according to claim 1, wherein the unlocking and driving yoke is formed in a single piece.

12. The device according to claim 1, wherein the direction of rotation of said second toothed wheel of the second mobile is opposite to that of said first toothed wheel of the first mobile.

13. A horological movement comprising the instantaneous control device of claim 1.

14. A timepiece comprising the horological movement of claim 13.

15. The timepiece of claim 14, wherein the timepiece comprises a wristwatch equipped with a mechanical horological movement.

16. A timepiece comprising the instantaneous control device of claim 1.

17. The timepiece according to claim 16, wherein the timepiece is a wristwatch equipped with a mechanical horological movement.

* * * * *